US008872051B2

(12) United States Patent
Marco et al.

(10) Patent No.: US 8,872,051 B2
(45) Date of Patent: Oct. 28, 2014

(54) CONTROL DEVICE FOR SWITCHES WITH SILICONE DOMES

(75) Inventors: Barile Marco, Rossana (IT); Rulfi Umberto, Centallo (IT); Ballatore Paolo, Busca (IT); Tallone Fabio, Frassino (IT)

(73) Assignee: Bitron S.p.A., Turin (IT)

( * ) Notice: Subject to any disclaimer, the term of this patent is extended or adjusted under 35 U.S.C. 154(b) by 623 days.

(21) Appl. No.: 13/136,026

(22) Filed: Jul. 20, 2011

(65) Prior Publication Data

US 2012/0018292 A1 Jan. 26, 2012

(30) Foreign Application Priority Data

Jul. 22, 2010 (IT) ..... TO2010A0636

(51) Int. Cl.
*H01H 13/85* (2006.01)

(52) U.S. Cl.
CPC ..... *H01H 13/85* (2013.01); *H01H 2201/004* (2013.01); *H01H 2205/002* (2013.01); *H01H 2215/018* (2013.01); *H01H 2209/074* (2013.01); *H01H 2237/004* (2013.01); *H01H 2221/072* (2013.01)
USPC ..... 200/517; 200/5 A

(58) Field of Classification Search
CPC ..... H01H 13/85; H01H 13/70; H01H 13/702
USPC ..... 200/5 A, 18, 512–517, 332
See application file for complete search history.

(56) References Cited

U.S. PATENT DOCUMENTS

| | | | | |
|---|---|---|---|---|
| 3,731,014 | A * | 5/1973 | Brady | 200/5 A |
| 4,349,712 | A | 9/1982 | Michalski | |
| 4,397,568 | A * | 8/1983 | Waki et al. | 200/517 |
| 6,621,017 | B2 * | 9/2003 | Shibutani et al. | 200/5 A |
| 6,812,424 | B2 * | 11/2004 | Miyako | 200/511 |
| 2002/0027062 | A1 | 3/2002 | Shibutani et al. | |
| 2009/0194402 | A1 | 8/2009 | Mao et al. | |

OTHER PUBLICATIONS

Italian Search Report dated Mar. 7, 2011.

* cited by examiner

*Primary Examiner* — Amy Cohen Johnson
*Assistant Examiner* — Marina Fishman
(74) *Attorney, Agent, or Firm* — Hedman & Costigan, P.C.; James V. Costigan; Kathleen A. Costigan

(57) ABSTRACT

A control device for switches with silicone domes comprising actuator means (10) which act on silicone domes (13) associated with metallic means adapted to close and selectively open electric contacts of a printed circuit activators characterized in that between each actuator means (10) and the respective silicone dome (13) a metallic plate (11) is positioned which rests one side on the dome (13) and the other on the printed circuit (15) and upon which said actuator means act.

10 Claims, 5 Drawing Sheets

CONTROL DEVICE FOR SWITCHES WITH SILICONE DOMES

Subject of the invention is a control device for switches with silicone domes.

In the automotive, until today the most on board used systems of switches can be summarized by the following types:

- switches with fast-snap metal sheets;
- switches with silicone bubbles with on-board contact;
- switches with silicone bubbles and metal contact integral with the electronic circuit;
- switches with metal snap domes (directly actuated or through silicone intermediary).

These different types of principles of operation have precise intrinsic features both at the mechanic level (forces, strokes and noise) and at the electric level, so that they do not in some cases satisfy the new demands of the automotive world.

The device which will be described below has been studied in order to realize a family of switches with such an actuating and closing system of the contact, such to obtain force/stroke features suitable for the new demands of the market, by at the same time optimizing the electric performances.

At the same time a switch is realized with IP52 protection with the same element (silicone mat) used for generating the feeling of actuation.

The aim of the new device is also to exploit some features of the silicone bubbles and others of the metal sheets in order to obtain a new result in terms of feeling without for this reason having to add components or degrade the electric aspects of the switch.

For these and further aims which will be better comprised hereafter, the invention proposes to realize a control device for switches with silicone domes comprising actuator means which act on silicone domes associated with metal means adapted to close and selectively open electric contacts of a printed circuit with activators of commands, characterized in that between each actuator means and the respective silicone dome a metal plate is interposed, which rests at one side on the dome and at the other on the printed circuit and upon which such actuator means act.

The device of the invention will now be described, with reference to the annexed drawings, in which.

Figure 1:
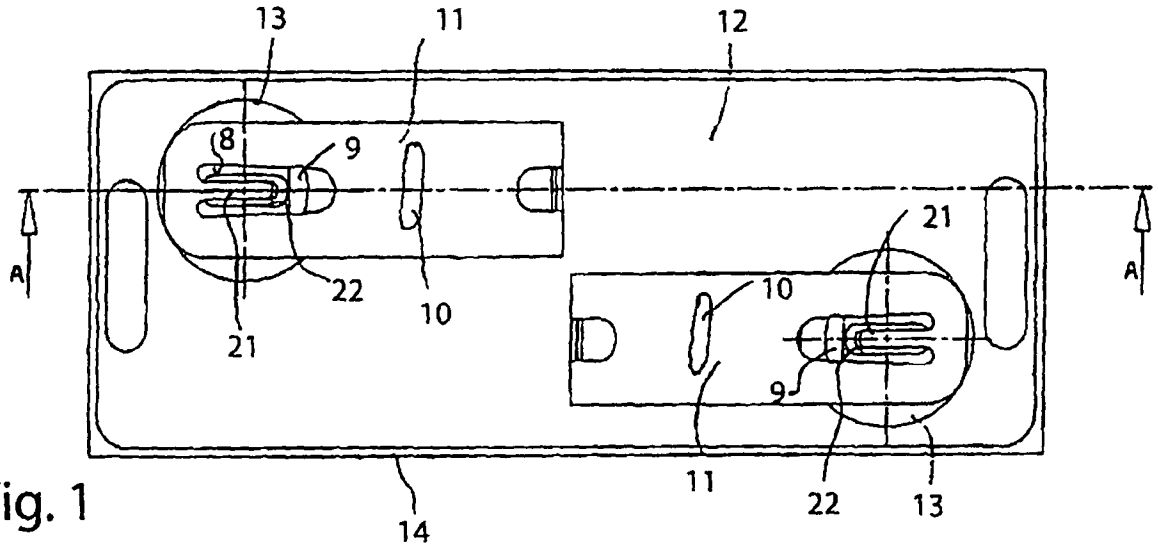
FIG. 1 is a top view of a switch according to the invention.
Figure 8:
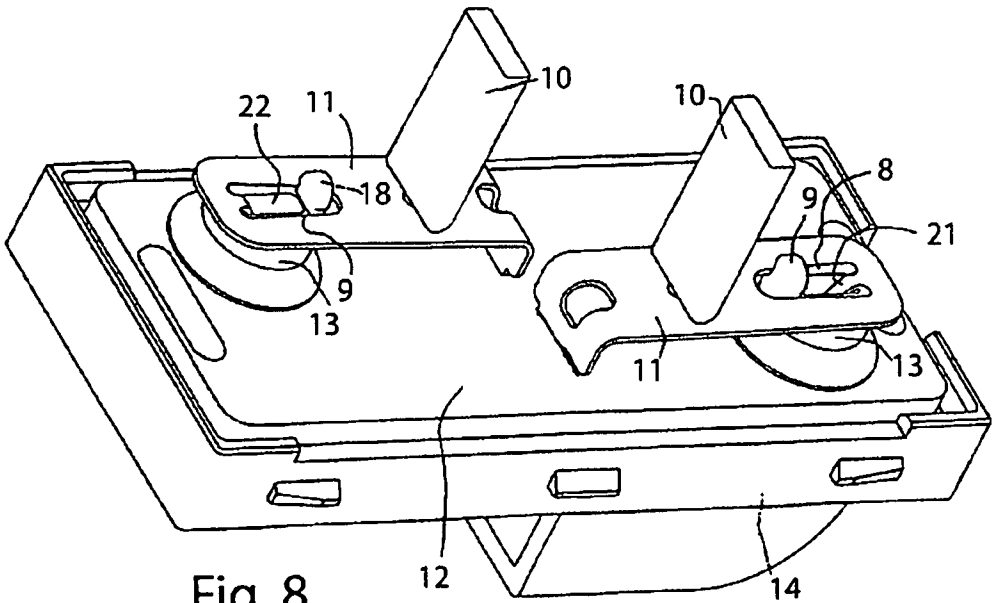
FIGS. 8 and 9 are a perspective and exploded view of the switch according to the invention, respectively.
Figure 9:
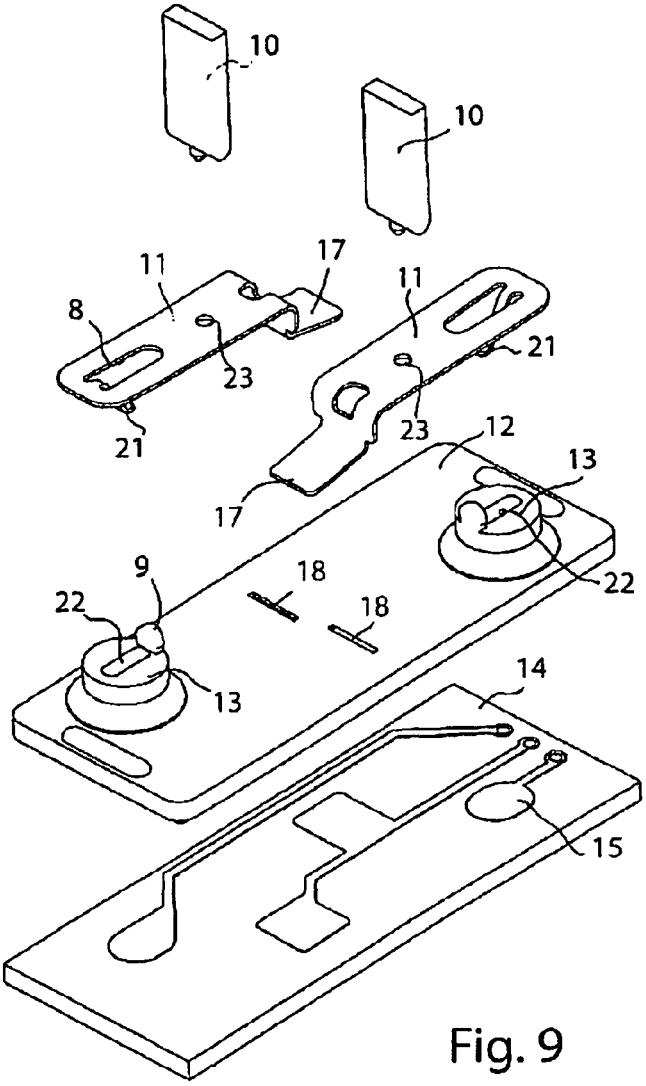

FIGS. 1, 8 and 9 show the main components of a switch provided with an actuation switch according to the invention, comprising vertical actuators 10, flexible actuation blades 11, a silicone mat 12 provided with bubbles or domes 13 and a printed circuit 14 with paths 15 for realizing a wiring diagram.

Figure 10:
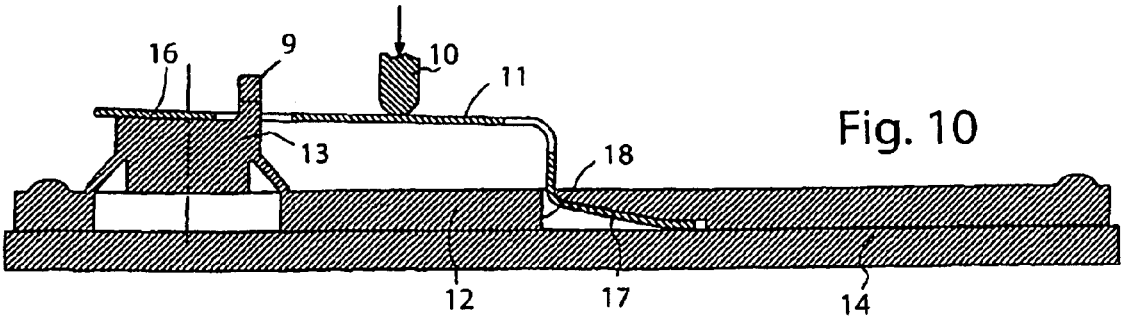
FIG. 10 is the A-A cross-section of FIG. 1 showing the general principle of the device according to the invention.

The device according to the invention is shown in its general shape in FIG. 10 where it can be noted that the actuation of each bubble or silicone dome 13 occurs by means of an elastic lever (sheet) 11 resting at respective ends 16 and 17 on bubble 13 and plate 14 of circuit 15, passing through an elongated hole 18 of silicone mat 12.

Obviously, in order to work the system so configured needs an electric contact actuated by the bubble on the circuit.

Figure 2:
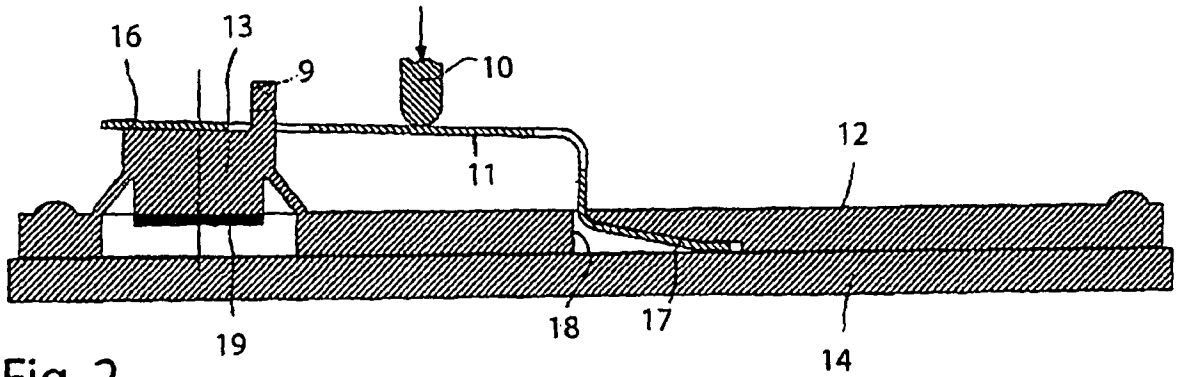
FIG. 2 shows the A-A cross-section of FIG. 1 in a first embodiment of the device according to the invention.
Figure 3:
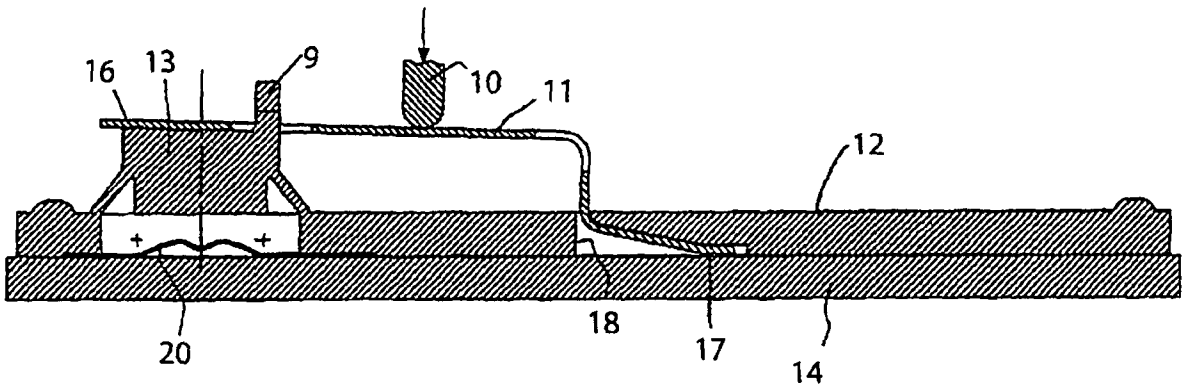
FIG. 3 shows the A-A cross-section of FIG. 1 in a second embodiment of the device according to the invention.
Figure 4:
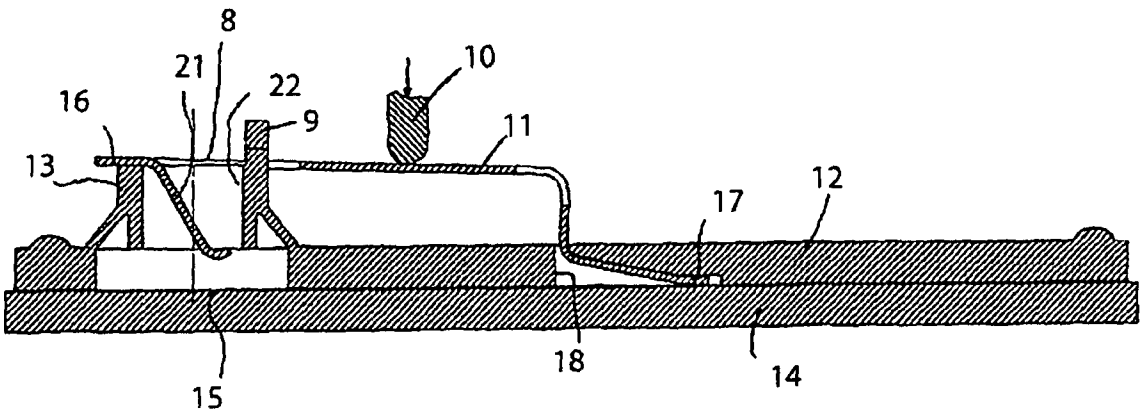
FIG. 4 shows the A-A cross-section of FIG. 1 in a third embodiment of the device according to the invention.
Figure 5:
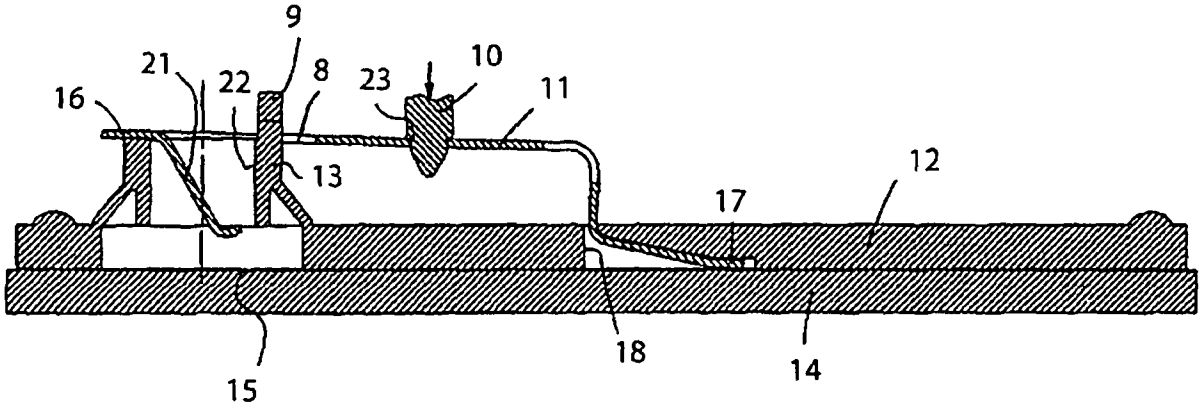
FIGS. 5, 6 and 7 show the A-A cross-section of FIG. 1 in a first embodiment of the device according to the invention and in three different operating positions.

FIGS. 2 and 3 show that in a traditional way the electric contact 19 can respectively be either integral with the dome itself or with a metal sheet 20 placed on the underlying circuit.

On the contrary, according to the invention, the electric contact can be integrally made by metal sheet 11 partially cut in order to form an appendix 21 turning inside bubble or dome 13 through one of its through holes 22. Bent contact element 21 of the sheet (a single piece sheet-contact) is so positioned at a predetermined distance from the circuit.

According to the invention, from each bubble 13 a protrusion 9 protrudes, which enters elongated hole 8 of sheet 11, obtained by cutting and turning bent appendix 21. The protrusion hinders side movements of sheet 11 with respect to bubble 13; in effect, it is important that the sheet be retained in order not to move laterally, avoiding the risk of distorting the contacts or in the case of important movements, of deactivating the switch.

Always according to the invention, a centering system is applied to actuator 10, by making it stuck into a hole 23 of the sheet 11 in an intermediate position with its two supports, in order to create the dragging.

Printed circuit 15 acts both as a support and as an electric connection element between the outlet connector and sheet 11.

Actuator 10 in its movement downwards pushes on sheet 11 causing both the progressive compression of silicone bubble 13 and the arching of the metal sheet (realized with a flexible geometry). This warping is equivalent to an energy accumulation which will thereafter be a fundamental element during the operation of the device.

The trend of the effort in relation to the displacement of actuator 10 is therefore defined both by the characteristic curve of the silicone bubble (which notoriously has a first length of stroke in which the force grows and a second length in which the same decreases, all with a trend similar to a sinusoid), and by the elastic feature of the metal sheet.

Figure 6:
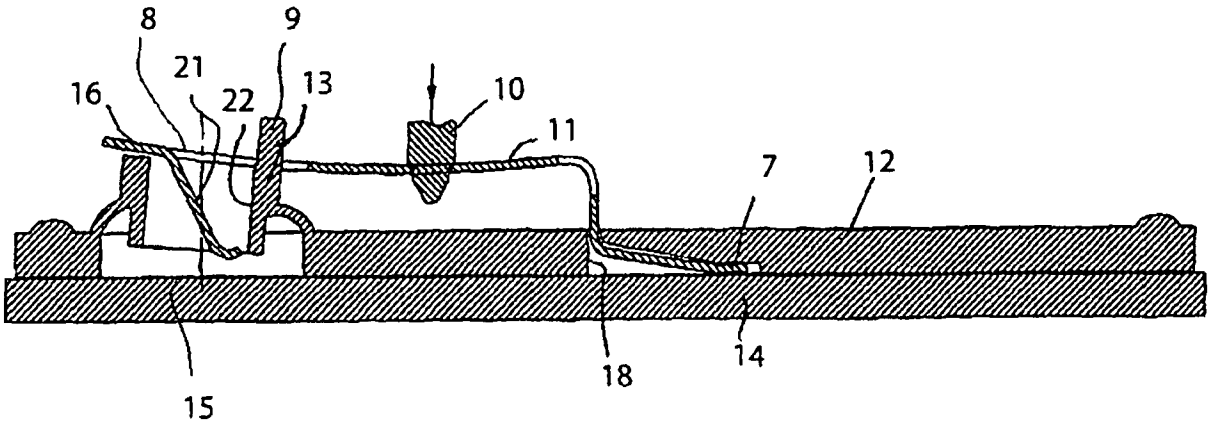
Figure 7:
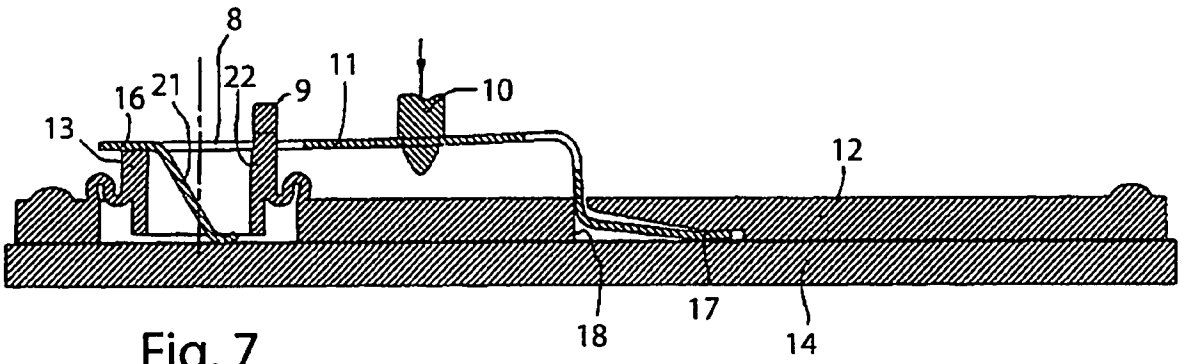

When the device has brought the silicone bubble in the stroke conditions which correspond to the maximum effort before collapsing (see FIG. 6) and consequently the sheet has its maximum warping, the reaction of the bubble begins to reduce itself and consequently the sheet gives back (almost instantly) the stored energy bringing the bubble itself up to the limit of stroke (see FIG. 7).

This behavior means on the graph force-displacement the postponement of the snap point (point of collapse of the bubble), but most of all in an abrupt switching from the maximum to the minimum reaction of the bubble (feature required by the automotive).

When contact 21 of the sheet comes in contact with the circuit, the stop of the stroke of the bubble occurs and the contact is closed.

The further stroke of the actuator is absorbed once again by the flexible metal sheet without damages. This "extra-stroke" has, for this kind of device, a great importance. In fact, following the particular geometry of the sheet itself, the extra-stroke causes a beneficial creep of the two resting regions 17, 21 of sheet 11 on circuit 15 with a consequent neverending cleaning of the surfaces interested and therefore of the keeping of the electric switching features, similar to those of the new device.

The return to the resting position of the whole system occurs with inverted modes; after a first short length in which the force decreases due to the decompression of all intermediate elements brought in compression and during which the user can possibly be able to slowly accompany the system, the system then arrives to the region of the characteristic curve of the silicone bubble in which a steep spike occurs of the reaction force of the same, and due to the flexibility of the sheet, the return movement of the bubble is absorbed by the sheet itself, so causing on the actuator the same abrupt variation of the force described at the beginning. From here on, the return of the actuator occurs with practically linear force/stroke trends up to the exhaustion of the elastic energy stored by the various elements.

The entire system described can be adopted both individually on switches of the "Push" kind (that is, those having a movement of the user interface element of the vertical kind), and in pairs on switches of the "tilting" kind (that is, having a movement of the user interface element of the rotary kind in two directions).

The device described before has the peculiarity of allowing a wide range of calibration and refinement of the final result from the point of view of the feeling.

In fact, the variation of geometry and position of the various elements involved entails that the obtained forces and strokes are practically endless.

Furthermore, the greater or smaller rapidity of descent of the curve in the snap phase is easily controlled and defined by putting in relation the intrinsic flexibility of the metal sheet with the own slope of the used bubble.

The use of the metal lever even for closing the contact allows an undoubted economic efficiency and an electric optimization which makes it possible to use the device even for critical electric applications (minimum currents).

The invention claimed is:

1. A control device for switches with silicone domes comprising actuator means (10) which act on silicone domes (13) associated with metallic means for closing and selectively opening electric contacts of printed circuit activators; wherein between each actuator means (10) and the respective silicone dome (13) is positioned a flexible metallic plate (11), which rests one side on the silicone dome (13) and upon which said actuator means (10) act, characterized in that:

actuation of each silicone dome (13) from a rest position occurs by means of an elastic lever formed by said flexible metallic plate (11), and in that;

the actuator means (10), as said actuator moves downwards, pushes on said flexible metallic plate (11) causing both the progressive compression of silicone dome (13) and the arching of said flexible metallic plate (11);

the arching of the flexible metallic plate (11) causing said flexible metallic plate to accumulate energy and said metallic flexible plate (11) has a maximum warp in a stroke condition of the controlling device which corresponds to the maximum effort before the collapse of silicone dome (13);

the reaction of the silicon dome (13) begins to reverse itself and consequently the flexible metallic plate (11) gives back accumulated energy causing the silicone dome (13) to return to said rest position.

2. The device according to claim 1 characterized in that the metallic means (19) for closing and selectively opening electric contacts are plates mounted on the silicone domes (13).

3. The device according to claim 1 characterized in that the metallic means (20) for closing and selectively opening electric contacts are plates positioned between the printed circuit (15) and the silicone domes (13).

4. The device according to claim 1 characterized in that the metallic means (21) for closing and selectively opening electric contacts are constituted by an appendix of the flexible metallic plate (11) passing through a hole (22) of the silicone dome (13) for acting on the contacts of the circuit itself.

5. The device according to claim 1 characterized in that the actuator (10) is fixed in a hole (23) of the flexible metallic plate (11) in a intermediate position with respect to two points of support where said two points of support are an end (17) of said flexible metallic sheet (11) and an appendix (21) that is shaped in such a way as to cause said appendix (21) to slide during actuation and disconnection of the switch.

6. The device according to claim 4 characterized in that the appendix (21) is obtained by cutting a tract of plate (11) and that the silicone dome (13) has a protuberance (9) which is inserted in the slot (8) of the flexible metallic plate (11), obtained by bending an end (17) of said appendix (21), said protuberance (9) being adapted to prevent lateral movements of the flexible metallic plate (11).

7. The device according to claim 1, in which said flexible metallic plate (11) rests one side on the silicone dome (13) and on the other side said flexible metallic plate (11) rests on electric contacts of said printed circuit activator.

8. A control device for switches with silicone domes comprising actuator means (10) which act on silicone domes (13) associated with metallic means for closing and selectively opening electric contacts of printed circuit activators; wherein between each actuator means (10) and the respective silicone dome (13) is positioned a flexible metallic plate (11), which rests one side on the silicone dome (13) and upon which said actuator means act, wherein the metallic means (21) for closing and selectively opening electric contacts are constituted by an appendix of the flexible metallic plate (11) passing through a hole (22) of the silicone dome (13) for acting on the contacts of the circuit itself.

9. The device according to claim 1 characterized in that the actuator (10) is fixed in a hole (23) of the flexible metallic plate (11) in a intermediate position with respect to two points of support where said two points of support are an end (17) of said flexible metallic sheet (11) and an appendix (21) that is shaped in such a way as to cause said appendix (21) to slide during actuation and disconnection of the switch.

10. The device according to claim 4 characterized in that the appendix (21) is obtained by cutting a tract of plate (11) and that the silicone dome (13) has a protuberance (9) which is inserted in the slot (8) of the flexible metallic plate (11), obtained by bending an end (17) of said appendix (21), said protuberance (9) being adapted to prevent lateral movements of the flexible metallic plate (11).

* * * * *